US012410976B2

(12) United States Patent
Lee et al.

(10) Patent No.: US 12,410,976 B2
(45) Date of Patent: Sep. 9, 2025

(54) HEAT EXCHANGER

(71) Applicant: LG ELECTRONICS INC., Seoul (KR)

(72) Inventors: Sukyoung Lee, Seoul (KR); Sangyeul Lee, Seoul (KR); Jaeyoung Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 48 days.

(21) Appl. No.: 18/378,941

(22) Filed: Oct. 11, 2023

(65) Prior Publication Data

US 2024/0125562 A1 Apr. 18, 2024

(30) Foreign Application Priority Data

Oct. 12, 2022 (KR) ..... 10-2022-0130774

(51) Int. Cl.
*F28F 1/12* (2006.01)

(52) U.S. Cl.
CPC ..... *F28F 1/128* (2013.01); *F28F 2215/08* (2013.01)

(58) Field of Classification Search
CPC ..... F28F 1/128; F28F 2215/08
USPC ..... 165/181
See application file for complete search history.

(56) References Cited

U.S. PATENT DOCUMENTS 4,465,128 A * 8/1984 Krekacs ..... F28F 1/32 165/182
4,691,768 A * 9/1987 Obosu ..... F28F 1/325 165/151
4,705,105 A * 11/1987 Cur ..... F28F 1/325 165/151
4,923,002 A * 5/1990 Haussmann ..... F28F 1/32 165/182
5,203,403 A * 4/1993 Yokoyama ..... F28F 1/32 165/182
5,207,270 A * 5/1993 Yokoyama ..... F28F 1/325 165/182
5,775,413 A * 7/1998 Kawanabe ..... F28F 1/32 165/181
5,927,393 A * 7/1999 Richter ..... F28F 1/32 165/182

(Continued)

FOREIGN PATENT DOCUMENTS

JP 8-178573 A 7/1996
JP 10-281674 A 10/1998

(Continued)

*Primary Examiner* — Claire E Rojohn, III
(74) *Attorney, Agent, or Firm* — Birch, Stewart, Kolasch & Birch, LLP

(57) ABSTRACT

A heat exchanger includes a heat transfer pipe for guiding a refrigerant; and a plurality of fins which respectively have a through-hole through which the heat transfer pipe passes and are disposed spaced apart from each other to allow air to pass in a first direction, wherein the fin includes: a corrugated form portion having an inclination with the first direction which is an air flow direction; and a sheet portion comprising a surface parallel to the first direction around the through hole, the sheet portion has a first length in the first direction which is an air flow direction, and has a second length longer than the first length in a second direction perpendicular to the air flow direction.

18 Claims, 5 Drawing Sheets

(56) References Cited

U.S. PATENT DOCUMENTS 6,889,759 B2 * 5/2005 Derosier ..... F28F 1/32 165/181
8,613,307 B2 * 12/2013 Kim ..... F28F 17/005 165/181
9,952,002 B2 * 4/2018 Wada ..... F28D 1/0477
11,293,701 B2 * 4/2022 Kim ..... F28D 1/04
11,761,714 B2 * 9/2023 Feng ..... F28D 1/0477 165/182
2004/0251016 A1 * 12/2004 Oh ..... F28F 1/32 165/172
2004/0261984 A1 * 12/2004 Derosier ..... F28F 1/32 165/182
2005/0045316 A1 * 3/2005 Oh ..... F28F 1/32 165/150
2005/0056407 A1 * 3/2005 Oh ..... F28F 1/32 165/151
2008/0190588 A1 * 8/2008 Heidenreich ..... F28F 1/325 165/181
2011/0120681 A1 * 5/2011 Seo ..... F24F 13/30 165/151
2011/0168373 A1 * 7/2011 Kim ..... F28F 1/28 165/181
2012/0267072 A1 * 10/2012 Park ..... F28F 17/005 165/181
2014/0034271 A1 * 2/2014 Lee ..... F28F 1/325 165/96
2014/0034272 A1 * 2/2014 Kim ..... F28F 1/00 165/104.11
2014/0158333 A1 * 6/2014 Kim ..... B23P 15/26 165/181
2016/0054065 A1 * 2/2016 Nagai ..... F28D 1/024 165/151
2016/0123681 A1 * 5/2016 Honma ..... F28F 1/12 165/181
2020/0096206 A1 * 3/2020 Kim ..... F28F 1/14
2020/0132395 A1 * 4/2020 Kim ..... F28D 1/04
2021/0123691 A1 * 4/2021 Lee ..... F24F 1/18
2023/0136711 A1 * 5/2023 Xiang ..... F28F 1/32 165/181
2024/0125562 A1 * 4/2024 Lee ..... F28F 1/32
2024/0247879 A1 * 7/2024 Lee ..... F28F 1/128
2024/0247881 A1 * 7/2024 Kim ..... F28F 17/005

FOREIGN PATENT DOCUMENTS

JP 5185611 B2 4/2013
WO WO 2013/181290 A1 10/2013

* cited by examiner

HEAT EXCHANGER

CROSS-REFERENCE TO RELATED APPLICATIONS

This application claims the priority benefit of Korean Patent Application No. 10-2022-0130774 filed on Oct. 12, 2022, in the Republic of Korea, which is hereby incorporated by reference in its entirety for all purposes as if fully set forth herein.

BACKGROUND OF THE DISCLOSURE

Technical Field

This disclosure relates to a heat exchanger having excellent heat exchange efficiency and low flow resistance.

Description of Related Art

In general, a heat exchanger may be used as a condenser or an evaporator in a refrigeration cycle device composed of a compressor, a condenser, an expansion mechanism, and an evaporator.

In addition, a heat exchanger can be installed in a vehicle, a refrigerator, or the like to exchange heat between refrigerant and air.

The heat exchanger may be classified into a fin tube type heat exchanger, a micro channel type heat exchanger, and the like, depending on a structure.

Recently, a heat exchanger with improved performance has been proposed by employing a corrugated fin formed by bending a fin in a corrugated form to more efficiently exchange heat between a refrigerant and air through the corrugated fin.

Prior Art Document 1 discloses that a plate fin 2 for improving the heat transfer rate in the fin side without increasing air-side pressure loss has at least three thread portions formed according to a column direction and a flat portion formed at the top of the thread portion according to a single direction.

However, in the case of the Prior Art Document, there is a problem in that air resistance is generated around a through hole 3 which is formed in the fin and through which a heat transfer pipe passes, and as a result, the heat exchange efficiency of the heat exchanger is lowered.

Patent Document 1—Japanese Registered Patent No. 5185611.

SUMMARY OF THE DISCLOSURE

The disclosure has been made in view of the above problems, and may provide a heat exchanger that is simple to manufactured, has excellent heat exchange efficiency, and has low air flow resistance.

The disclosure may further provide a heat exchanger having a structure including a through hole through which a heat transfer pipe passes, a corrugated form portion which moves (i.e., extends) in a first direction, which is an air flow direction, and is formed in a zigzag shape, and a flat portion provided in a plane adjacent to the through hole, so that air can be actively mixed in the corrugated form portion and the vicinity of the through hole.

The disclosure may further provide a heat exchanger in which the heat transfer pipe does not interfere with the air flow in the direction of air flow, and the air can be mixed uniformly in the direction perpendicular to the air flow direction, by disposing a through hole to which two rows of heat transfer pipes are coupled in a zigzag pattern.

In a heat exchanger according to the present disclosure, a sheet portion has a first length in a first direction which is an air flow direction, and has a second length longer than the first length in a second direction perpendicular to the air flow direction.

In detail, a heat exchanger according to the present disclosure includes: a heat transfer pipe for guiding a refrigerant; and a plurality of fins which respectively have a through-hole through which the heat transfer pipe passes and are disposed spaced apart from each other to allow air to pass in a first direction, wherein the fin includes: a corrugated form portion having an inclination with the first direction which is an air flow direction; and a sheet portion including a surface parallel to the first direction around the through hole, wherein the sheet portion has a first length in the first direction which is an air flow direction, and has a second length longer than the first length in a second direction perpendicular to the air flow direction.

The fin further includes a collar in surface contact with the heat transfer pipe, and the sheet portion is connected to an outer surface of the collar.

The sheet portion is formed by a first arc passing through a first point which is one distal end of the first direction and a tangent line thereof, a second arc passing through a second point which is the other distal end point of the first direction and a tangent line thereof, a third arc passing through a third point which is one distal end point of the second direction and a tangent line thereof, and a fourth arc passing through a fourth point which is the other distal end point of the second direction and a tangent line thereof.

A center of curvature of the first arc and a center of curvature of the second arc are located symmetrically in the first direction with respect to a center of the heat transfer pipe.

A center of curvature of the third arc and a center of curvature of the fourth arc are located symmetrically in the second direction with respect to a center of the heat transfer pipe.

The first arc and the second arc have a first radius of curvature, and the third arc and the fourth arc have a second radius of curvature greater than the first radius of curvature.

The sheet portion is formed in an elliptical shape in which two focal points are symmetrically located in the second direction with respect to a center of the heat transfer pipe.

The corrugated form portion is located between sheet portions adjacent to each other.

A ratio of the second length of the sheet portion to the first length of the sheet portion is in the range of 1.2 to 1.9.

The corrugated form portion includes a plurality of inclined portions having an inclination with respect to the first direction.

The corrugated form portion includes four inclined portions, and two thread portions and one groove portion.

A center of the through hole is located to overlap the groove portion in the second direction.

The two thread portions are disposed not to overlap with the through hole in the second direction.

The two thread portions are disposed not to overlap with the sheet portion in the second direction.

The two thread portions are located higher than the sheet portion in a third direction orthogonal to the first direction and the second direction.

The heat exchanger further includes a connecting portion connecting the corrugated form portion and the sheet portion.

The connecting portion has an inclination with respect to a third direction orthogonal to the first direction and the second direction.

In addition, an air conditioner according to the present disclosure includes an indoor heat exchanger that exchanges heat with indoor air; an indoor heat exchanger that exchanges heat with outdoor air, wherein at least one of the indoor heat exchanger and the indoor heat exchanger includes: a heat transfer pipe for guiding a refrigerant; and a plurality of fins which respectively have a through-hole through which the heat transfer pipe vertically passes and are disposed spaced apart from each other to allow air to pass in a first direction, wherein the fin includes: a corrugated form portion which proceeds in a first direction which is an air flow direction and is formed in a zigzag pattern; and a sheet portion including a surface parallel to the first direction around the through hole, wherein the sheet portion has a first length in the first direction which is an air flow direction, and has a second length longer than the first length in a second direction perpendicular to the air flow direction.

In addition, a fin according to the present disclosure includes a corrugated form portion having an inclination with respect to a first direction; and a sheet portion which includes a through hole in which a heat transfer pipe is installed, and includes a surface parallel to the first direction around the through hole, wherein the sheet portion has a first length in the first direction, and has a second length longer than the first length in a second direction perpendicular to an air flow direction.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION OF THE EMBODIMENTS

Figure 1:
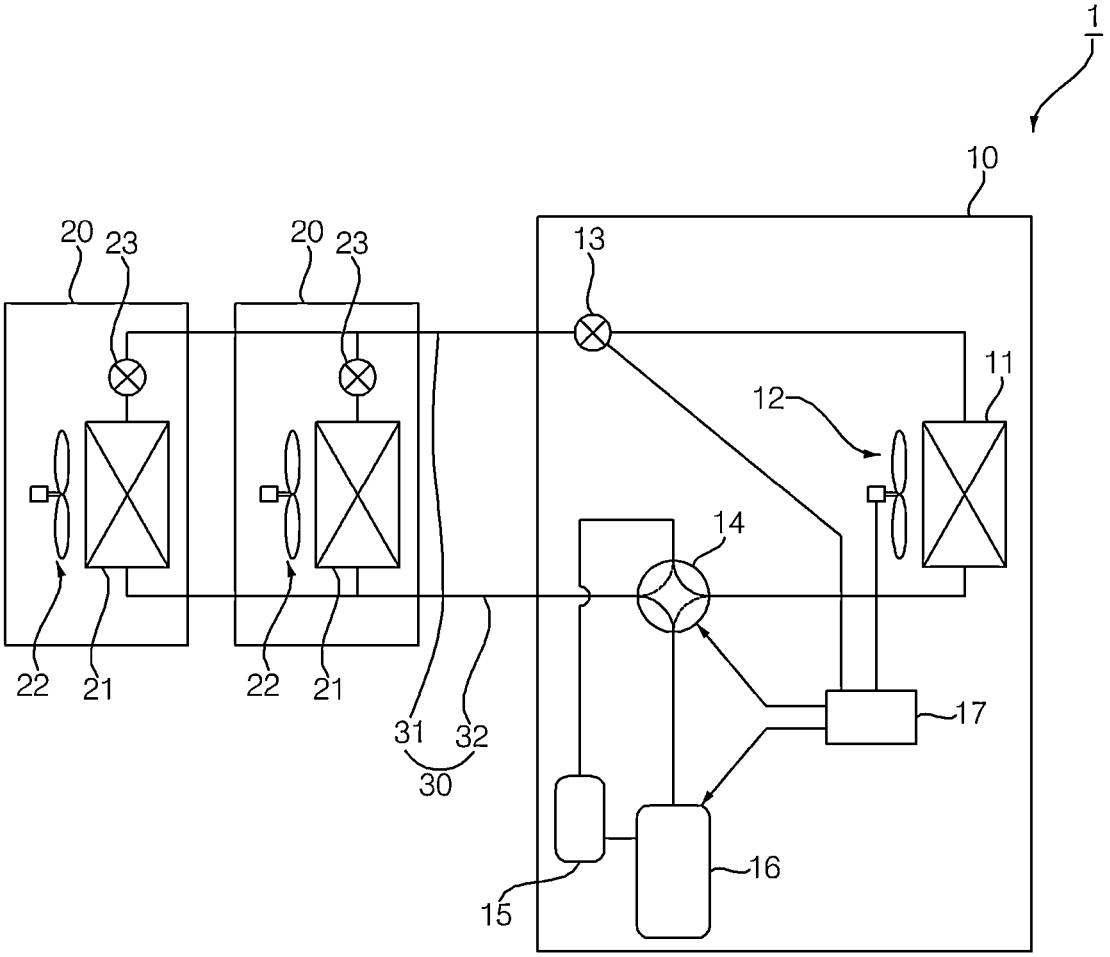
FIG. 1 is a schematic diagram of an air conditioner according to an embodiment of the present disclosure.

Advantages and features of the present disclosure and methods of achieving them will become apparent with reference to the embodiments described below in detail in conjunction with the accompanying drawings. However, the present disclosure is not limited to the embodiments disclosed below, but may be implemented in various different forms, and these embodiments are provided only to allow the disclosure of the present disclosure to be complete, and to completely inform those of ordinary skill in the art to which the present disclosure belongs, the scope of the invention, and the present disclosure is only defined by the scope of the claims. Like reference numerals refer to like elements throughout.

The terms spatially relative, "below", "beneath", "lower", "above" and "upper" and the like can be used to easily describe the correlation of elements with other elements. Spatially relative terms should be understood in terms of the directions shown in the drawings, including the different directions of components at the time of use or operation. For example, when inverting an element shown in the drawings, an element described as "below" or "beneath" of another element may be placed "above" of another element. Thus, the exemplary term "below" may include both downward and upward directions. The elements may also be oriented in a different direction, so that spatially relative terms can be interpreted according to orientation.

The terminology used herein is for the purpose of illustrating embodiments and is not intended to restrict the invention. In this specification, singular forms include plural forms unless the context clearly dictates otherwise. It is noted that the terms "comprises" and/or "comprising" used in the specification mean that mentioned elements, steps, and/or operations do not exclude the presence or addition of one or more of other elements, steps, and/or operations.

Unless defined otherwise, all terms (including technical and scientific terms) used herein may be used in a sense commonly understood by a person having ordinary skill in the art to which the claimed invention pertains. In addition, commonly used predefined terms are not ideally or excessively interpreted unless explicitly defined otherwise.

In the drawings, the thicknesses and sizes of respective elements are exaggerated, omitted, or schematically shown for convenience and clarity of explanation. In addition, the size and area of each element do not entirely reflect actual size or area.

In addition, angles and directions mentioned when describing the structure of the embodiment are based on those described in the drawings. In the description of the structure constituting the embodiment in the specification, if the reference point and the positional relationship for the angle are not clearly mentioned, refer to the related drawings.

Hereinafter, the present disclosure will be described in detail with reference to the accompanying drawings.

FIG. 1 is a schematic diagram of an air conditioner according to an embodiment of the present disclosure, and shows a case in which a heating operation is performed.

As shown in FIG. 1, the air conditioner includes an outdoor unit 10 disposed in an outdoor space, a plurality of indoor units 20 installed in an indoor space, and refrigerant pipes 31 and 32 connecting the outdoor unit 10 and the plurality of indoor units 20 so that a refrigerant circulates between the outdoor unit 10 and the plurality of indoor units 20.

In this embodiment, two indoor units 20 are connected to one outdoor unit 10, but this is an example and is not limited thereto. That is, one indoor unit 20 may be connected to one outdoor unit 10, or three or more indoor units 20 may be connected to one outdoor unit 10.

The outdoor unit 10 includes an outdoor heat exchanger 11 for exchanging heat between outdoor air and a refrigerant, an outdoor blower 12 for allowing outdoor air to pass through the outdoor heat exchanger 11, a compressor 16 for compressing the refrigerant, a four-way valve 14 for guiding the refrigerant discharged from the compressor 16 to one of the outdoor unit 10 and the indoor unit 20, an outdoor expansion valve 13 for reducing pressure and expanding the refrigerant, and an accumulator 15 separating liquid refrigerant from refrigerant flowing into the compressor 16 so that the liquid refrigerant vaporizes and then flows into the compressor 16.

In addition, the outdoor unit 10 includes a controller 17 that controls the operation of the outdoor blower 12, the outdoor expansion valve 13, the compressor 16, and the four-way valve 14. The controller 17 may be composed of a microcomputer (i.e., hardware-embedded processor) or the like.

The indoor unit 20 includes an indoor heat exchanger 21 that allows heat exchange between indoor air and the refrigerant, an indoor blower 22 that allows the indoor air to pass through the indoor heat exchanger 21, and an indoor expansion valve 23 that reduces pressure and expands the refrigerant.

The refrigerant pipe 30 includes a liquid refrigerant pipe 31 through which liquid refrigerant passes, and a gaseous refrigerant pipe 32 through which gaseous refrigerant passes. The liquid refrigerant pipe 31 allows the refrigerant to flow between the indoor expansion valve 23 and the outdoor expansion valve 13.

The gaseous refrigerant pipe 32 guides the refrigerant to move between the four-way valve 14 of the outdoor unit 10 and the gas side of the indoor heat exchanger 21 of the indoor unit 20.

It is preferable that any one of hydrocarbon (HC) single refrigerant, HC mixed refrigerant, R32, R410A, R407C, and carbon dioxide is used as the above described refrigerant used in the air conditioner. Alternatively, any known refrigerant can be used.

Figure 2:
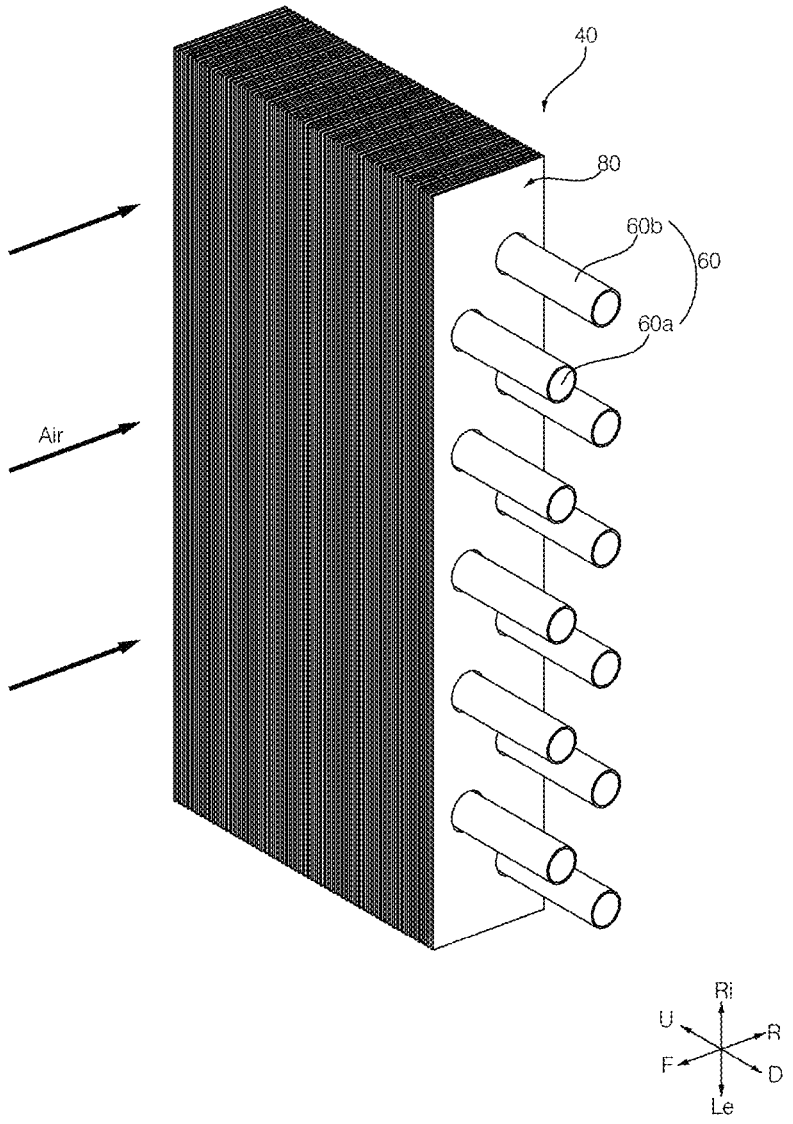
FIG. 2 is a perspective view of a heat exchanger according to an embodiment of the present disclosure.
Figure 3:
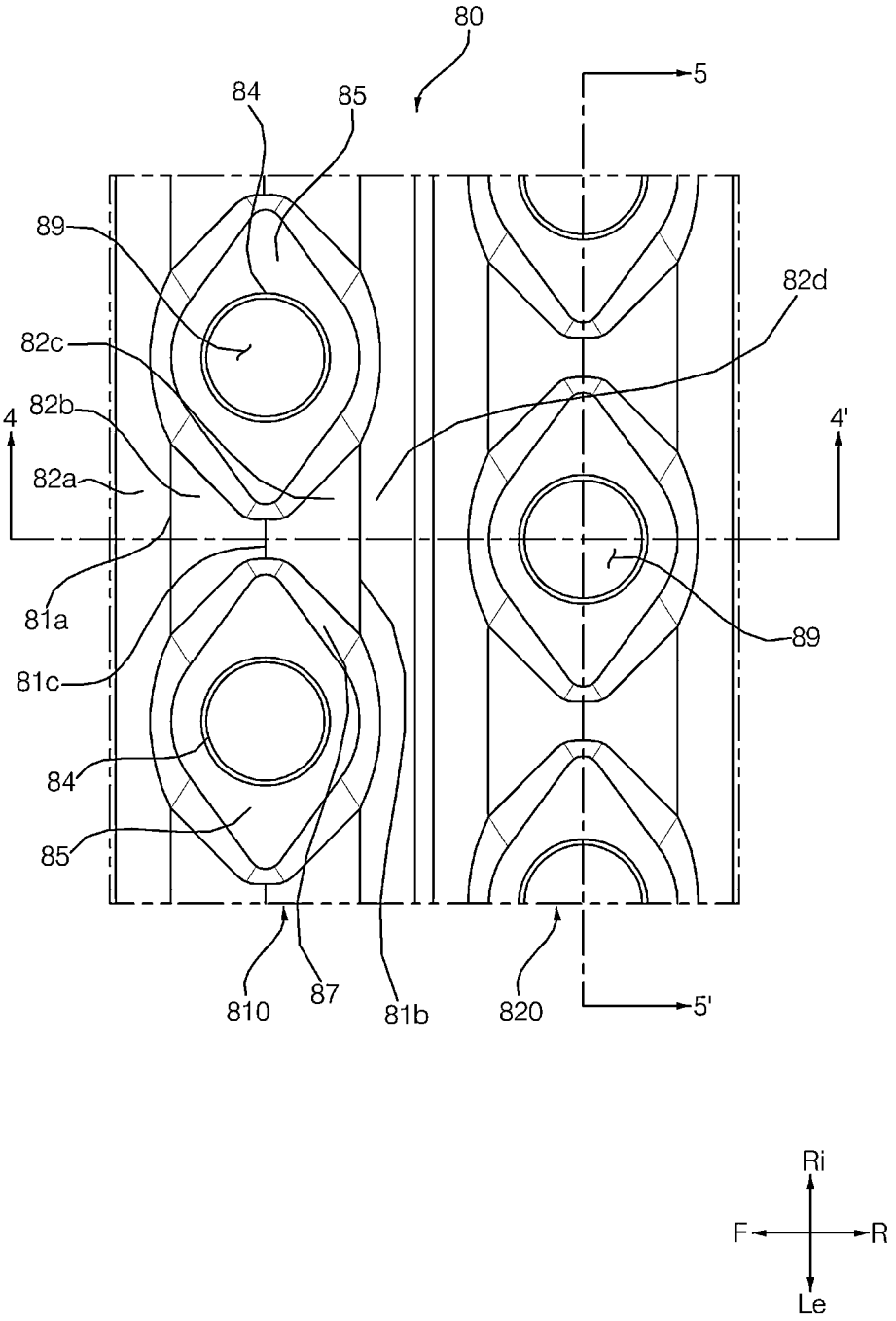
FIG. 3 is an enlarged plan view of a part of a fin according to an embodiment of the present disclosure.

FIG. 2 is a perspective view of a heat exchanger 40 according to an embodiment of the present disclosure, and FIG. 3 is an enlarged plan view of a part of a fin according to an embodiment of the present disclosure;

Referring to FIGS. 2 and 3, the heat exchanger 40 corresponds to at least one of the outdoor heat exchanger 11 and the indoor heat exchanger 21 shown in FIG. 1.

The heat exchanger 40 is a fin tube type heat exchanger, and includes a plurality of fins 80 made of aluminum and a heat transfer pipe 60 having a circular cross section made of copper or aluminum.

A plurality of heat transfer pipes 60 extend in a left-right direction (second direction) LeRi orthogonal to the air flow direction. Specifically, the heat transfer pipe 60 may include a plurality of first row heat transfer pipes 60*a* spaced apart from each other in the up-down direction (third direction or vertical direction) UD, and a plurality of second row heat transfer pipes 60*b* spaced apart in a rearward direction from the first row heat transfer pipes 60*a*, and spaced apart in the up-down direction.

The pitch of the first row heat transfer pipes 60*a* is the same as the pitch of the second row heat transfer pipes 60*b*, and the first row heat transfer pipes 60*a* and the second row heat transfer pipes 60*b* are disposed not to overlap each other in the front-rear direction. If the first row heat transfer pipes 60*a* and the second row heat transfer pipes 60*b* are disposed not to overlap each other in the front-rear direction, it is possible to reduce the resistance of air flowing in the front-rear direction due to the heat transfer pipes 60.

The plurality of fins 80 are vertically disposed with respect to the heat transfer pipe 60 and are spaced apart from each other so that air passes between the plurality of fins 80 in a first direction (front-rear direction) FR. The heat transfer pipe 60 is vertically installed to penetrate through-holes 89 provided in each of the fins 80 and is disposed parallel to each other. The heat transfer pipe 60 is connected to the refrigerant pipes 30 of the air conditioner of FIG. 1 to form a closed circuit refrigerating cycle.

In addition, since the heat transfer pipe 60 contacts the fin 80 to transmit or receive heat through the fin 80, the contact area with the air passing through the heat exchanger 40 through the fin 80 is widened. Therefore, heat exchange between the refrigerant passing through the inside of the heat transfer pipe 60 and the refrigerant passing through the heat exchanger 40 is efficiently performed through the fin 80.

In order for heat transfer between the fin 80 and the air to be more efficient, the fin 80 proceeds in the first direction (front-rear direction) of the air flow direction through a press mold and is bent in a zigzag pattern, so that the fin 80 may be formed in a corrugated form. Hereinafter, the fin 80 having a corrugated form formed as described above may be referred to as a corrugate fin.

The fin 80 includes a collar 84 in surface contact with the heat transfer pipe 60, and a sheet portion 85 provided in a plane around the collar 84 to form the collar 84. Since the sheet portion 85 is adjacent to the collar 84 in contact with the heat transfer pipe 60, it has a temperature similar to that of the refrigerant passing through the heat transfer pipe 60. The sheet portion 85 is connected to the outer surface of the collar 84.

The collar 84 extends in the left-right direction from the sheet portion 85 and has a cylindrical shape.

Therefore, since heat exchange between the refrigerant and air can be efficiently performed in the sheet portion 85, the heat exchange efficiency of the heat exchanger 40 can be improved by allowing more air to come into contact with the sheet portion 85.

Figure 4:
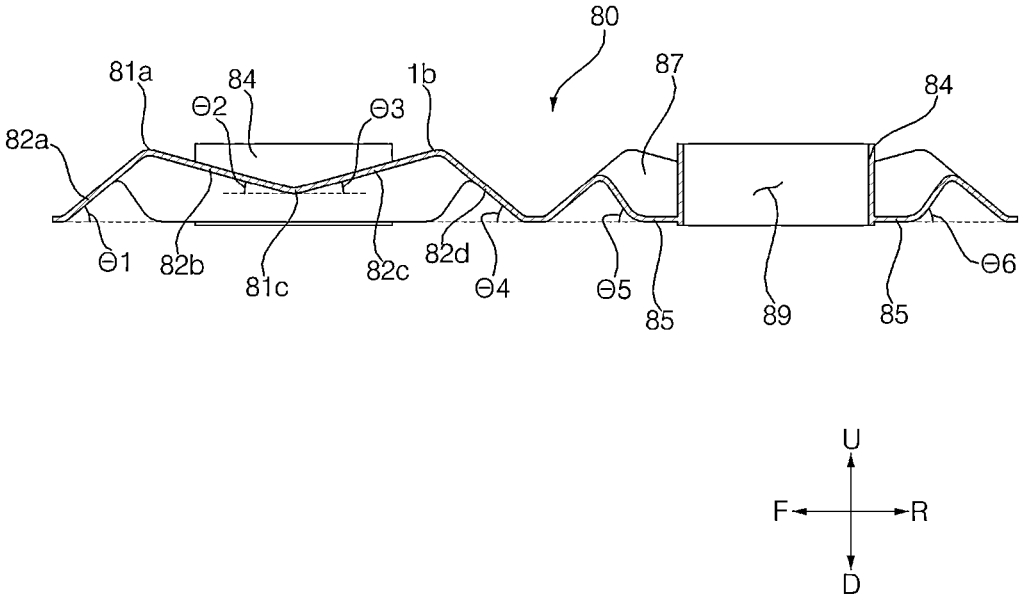
FIG. 4 is a cross-sectional view of the fin shown in FIG. 3 taken along line 4-4'.
Figure 5:
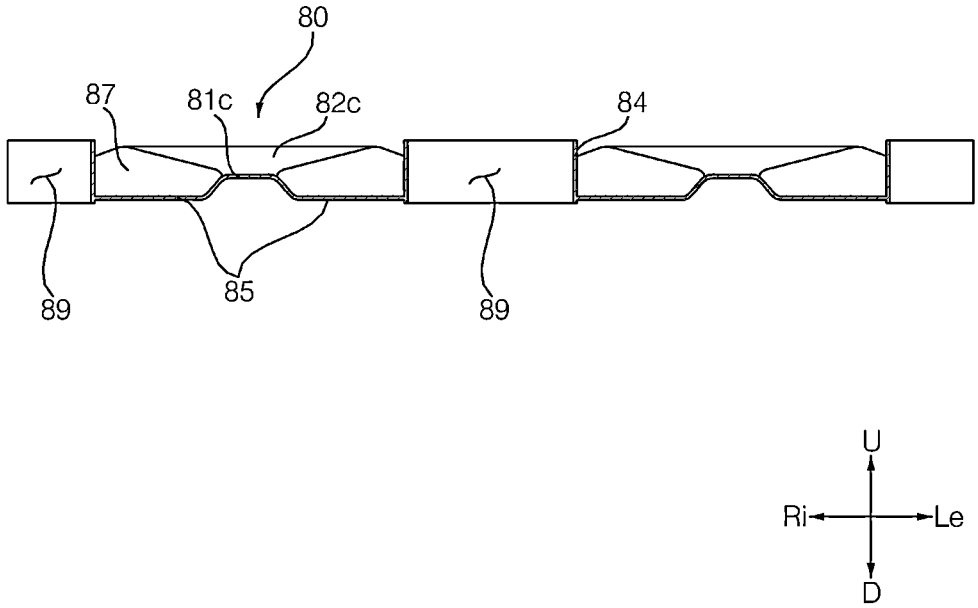
FIG. 5 is a cross-sectional view of the fin shown in FIG. 3 taken along line 5-5'.
Figure 6:
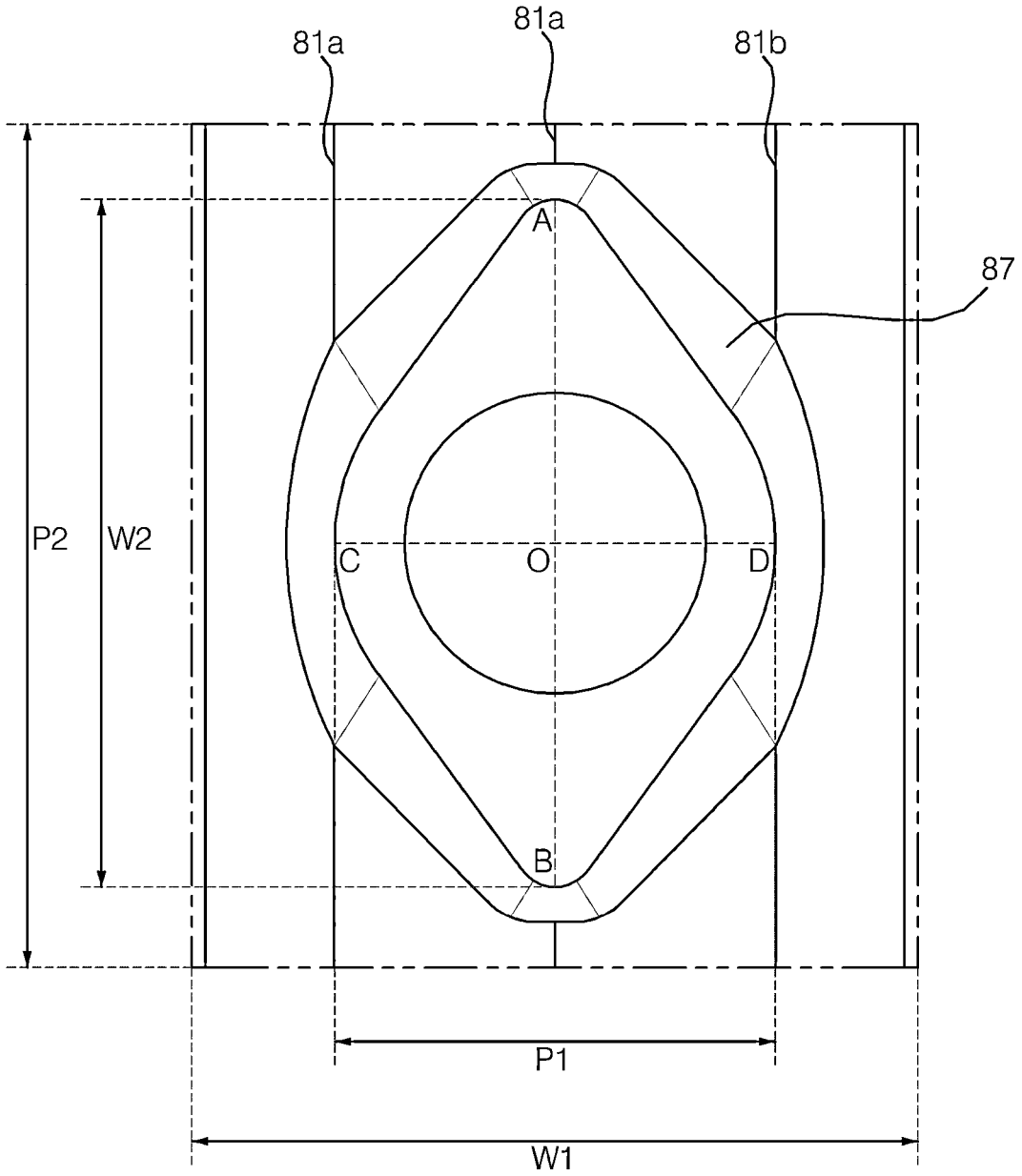
FIG. 6 is an enlarged view of a part of FIG. 3.

FIG. 4 is a cross-sectional view of the fin shown in FIG. 3 taken along line 4-4', FIG. 5 is a cross-sectional view of the fin shown in FIG. 3 taken along line 5-5', and FIG. 6 is an enlarged view of a part of FIG. 3.

Referring to FIGS. 3 to 6, the sheet portion 85 may define a surface parallel to the first direction around the through hole 89. Specifically, the sheet portion 85 may be defined as a plane parallel to the first direction (front-rear direction) and the second direction (up-down direction) around the through hole 89.

The sheet portion 85 is formed to have a first length in the first direction which is an air flow direction and a second length longer than the first length in a second direction perpendicular to the first direction, and a corrugated form portion between the sheet portion 85 and two adjacent sheet portions 85 allows a lot of air to be exchanged and mixed with each other, thereby improving the heat exchange efficiency of the heat exchanger 40.

In the embodiment, the sheet portion 85 is formed in an oval type shape elongated in the second direction perpendicular to the air flow direction. Obviously, in another embodiment, the sheet portion 85 may have a rhombus shape elongated in the second direction.

The fin 80 includes a corrugated form portion. The corrugated form portion is a region that proceeds in a first direction which is an air flow direction and is formed in a zigzag pattern. The corrugated form portion is located between the sheet portions 85 adjacent to each other. The corrugated form portion may have an inclination in a first direction.

The corrugated form portion includes four inclined portions 82*a*, 82*b*, 82*c*, and 82*d*, and two thread portions 81*a*,

81*b* and one groove portion 81*c* that are formed by the four inclined portions 82*a*, 82*b*, 82*c*, and 82*d*.

The thread portion 81*a* and 81*b* include a first thread portion 81*a* located relatively forward and a second thread portion 81*b* located rearward from the first thread portion 81*a*, and the groove portion 81*c* is located between the first thread portion 81*a* and the second thread portion 81*b*.

The four inclined portions 82*a*, 82*b*, 82*c*, and 82*d* have an inclination with respect to the first direction (front-rear direction) and extend in the second direction.

Specifically, the inclined portions 82*a*, 82*b*, 82*c*, and 82*d* may include a first inclined portion 82*a* connected to the front of the first thread portion 81*a*, a second inclined portion 82*b* which is connected to the rear of the first thread portion 81*a* and connects the first thread portion 81*a* and the groove portion 81*c*, a third inclined portion 82*c* which is connected to the front of the second thread portion 81*b* and connects the second thread portion 81*b* and the groove portion 81*c*, and a fourth inclined portion 82*d* connected to the rear of the second thread portion 81*b*.

Here, the thread portions 81*a*, 81*b* and the groove portion 81*c* are folded portions that occur when the corrugated fin 80 is bent to form the inclined portion 82*a*, 82*b*, 82*c*, and 82*d*, and the inclined portions 82*a*, 82*b*, 82*c*, and 82*d* are inclined surfaces inclined with respect to the surface of the fin 80 before forming the inclined portions 82*a*, 82*b*, 82*c*, and 82*d*.

Accordingly, the fin 80 includes the thread portion 81*a*, 81*b*, the groove portion 81*c*, and the inclined portions 82*a*, 82*b*, 82*c*, and 82*d* connected to each other in a zigzag pattern through the thread portion 81*a*, 81*b* and the groove portion 81*c*. A zigzag-patterned corrugated form portion is formed by the above thread portions 81*a*, 81*b*, the groove portion 81*c*, and the inclined portions 82*a*, 82*b*, 82*c*, and 82*d*.

The width of the second inclined portion 82*b* may decrease in the second direction from the front to the rear, and the width of the third inclined portion 82*c* may increase in the second direction from the front to the rear.

The first thread portion 81*a*, the second thread portion 81*b*, and the groove portion 81*c* extend in the second direction. The center of the through hole 89 may be located to overlap the groove portion 81*c* in the second direction. Two thread portions may be disposed not to overlap with the through hole 89 in the second direction.

The two thread portions 81*a* and 81*b* may be disposed not to overlap with the sheet portion 85 in the second direction. The sheet portion 85 is located between the two thread portions 81*a* and 81*b*.

Accordingly, the air is uniformly mixed in the second direction due to the interaction of the sheet portion 85, the groove portion 81*c*, and the thread portion.

The two thread portions are located higher than the sheet portion 85 in the third direction (up-down direction). In addition, the groove portion 81*c* is located higher than the sheet portion 85 in the third direction. The two thread portions are located lower than the upper end of the collar 84 in the third direction. In addition, the groove portion 81*c* is located lower than the upper end of the collar 84 in the third direction.

A first inclination angle Θ1 of the first inclination portion 82*a* with respect to the first direction is equal to a fourth inclination angle Θ4 of the fourth inclination portion 82*d* with respect to the first direction. A second inclination angle Θ2 of the second inclination portion 82*b* with respect to the first direction is equal to a third inclination angle Θ3 of the third inclination portion 82*c* with respect to the first direction.

The first inclination angle Θ1 of the first inclination portion 82*a* with respect to the first direction and the fourth inclination angle Θ4 of the fourth inclination portion 82*d* with respect to the first direction may be greater than the second inclination angle Θ2 of the second inclination portion 82*b* with respect to the first direction and the third inclination angle Θ3 of the third inclination portion 82*c* with respect to the first direction.

The first inclination angle Θ1 of the first inclination portion 82*a* with respect to the first direction and the fourth inclination angle Θ4 of the fourth inclination portion 82*d* with respect to the first direction range from 30 degrees to 45 degrees, and the second inclination angle Θ2 of the second inclination portion 82*b* with respect to the first direction and the third inclination angle Θ3 of the third inclination portion 82*c* with respect to the first direction range from 7 degrees to 20 degrees.

Preferably, the first thread portion 81*a* and the second thread portion 81*b* may have a symmetrical shape in the front-rear direction based on the groove portion 81*c*.

Here, the width of the fin 80 (hereinafter referred to as "fin width") may be referred to as P1, and a gap between the heat transfer pipes 60 may be referred to as P2. The sheet portion 85 has a first length W1 in a first direction which is an air flow direction, and has a second length W2 in a second direction perpendicular to the first direction which is an air flow direction.

When both ends of the sheet portion 85 in the first direction are referred to as points C and D, the points C and D are provided at positions symmetrical in the first direction with respect to the center O of the heat transfer pipe 60. In addition, when both ends of the sheet portion 85 in the second direction are referred to as points A and B, the points A and B are provided at positions symmetrical in the second direction with respect to the center O of the heat transfer pipe 60.

Therefore, the distance between the points C and D is the aforementioned first length W1, and the distance between the points A and B is the aforementioned second length W2.

Here, the center O of the heat transfer pipe 60 is located at a position corresponding to the groove portion 81*c*.

The expression "elliptical shape" is a term for collectively referring to a shape which is similar to an ellipse as a first length in a first direction which is the air flow direction is formed shorter than a second length in a second direction perpendicular to the air flow direction.

In the embodiment, the sheet portion 85 is formed in a substantially elliptical shape by a left first arc passing through a point C and its tangent line, a right second arc passing through a point D and its tangent line, an upper third arc passing through a point A and its tangent line, and a lower fourth arc passing through a point B and its tangent line.

It is preferable that the first arc and the second arc have a center of curvature on a straight line connecting the point C, the center O of the heat transfer pipe 60, and the point D, and the third arc and the fourth arc have a center of curvature on a straight line connecting point A, the center O of the heat transfer pipe 60, and the point B. However, it is not limited thereto.

In the elliptical sheet portion 85, the first arc and the second arc have a radius of curvature R1, and the third arc and the fourth arc have a radius of curvature R2 greater than R1. However, it is not limited thereto, and the sheet portion 85 may be formed in various elliptical type shapes in which the first length W1 is shorter than the second length W2.

The sheet portion 85 is preferably formed in an elliptical shape in which two focal points are symmetrically located in the second direction with respect to the center O of the heat transfer pipe 60. It is preferable that the ratio of the second length W2 of the sheet portion 85 to the first length W1 of the sheet portion 85 is in the range of 1.2 to 1.9.

The fin 80 includes a connecting portion 87 connecting a corrugated form portion and a flat portion. The connecting portion 87 connects the thread portions 81*a* and 81*b* and the groove portion 81*c* that form the corrugated form portion and the sheet portion 85. The connecting portion 87 is formed to surround the sheet portion 85.

Therefore, since the condensed water generated in the heat exchanger 40 can easily move along the groove portion 81*c*, condensed water is prevented from accumulating in the sheet portion 85, thereby suppressing an increase in air resistance in the sheet portion 85.

The connection portion 87 may have an inclination with respect to the first direction and the third direction. Specifically, the inclination angle Θ5 and 06 between the connection portion 87 and the first direction may be greater than the first inclination angle Θ1 of the first inclination portion 82*a* with respect to the first direction, the fourth inclination angle Θ4 of the fourth inclination portion 82*d* with respect to the first direction, the second inclination angle Θ2 of the second inclination portion 82*b* with respect to the first direction, and the third inclination angle Θ3 of the third inclination portion 82*c* with respect to the first direction.

The center of the groove portion 81*c* and the thread portion 81*a*, 81*c* may overlap with the center O of the heat transfer pipe 60 in the front-rear direction.

The heat exchanger of the present disclosure has one or more of the following effects.

First, the present disclosure has a structure including a through hole through which a heat transfer pipe passes, a corrugated form portion which moves in a first direction, which is an air flow direction, and is formed in a zigzag shape, and a flat portion provided in a plane adjacent to the through hole, so that air can be actively mixed in the corrugated form portion and the vicinity of the through hole.

Second, the present disclosure disposes a through hole to which two rows of heat transfer pipes are coupled in a zigzag pattern, so that the heat transfer pipe does not interfere with the air flow in the direction of air flow, and the air can be mixed uniformly in the direction perpendicular to the air flow direction.

Third, the present disclosure has the advantage that the air passing through the flat portion and the air passing through the inclined portion can be actively mixed, because the flat portion where the through hole through which the heat transfer pipe passes is formed has an elongated oval type shape in a direction perpendicular to the air flow direction.

Fourth, the present disclosure has a structure including a through hole through which a heat transfer pipe passes, a corrugated form portion which moves in a first direction, which is an air flow direction, and is formed in a zigzag shape, and a flat portion provided in a plane adjacent to the through hole, thereby easily discharging condensate through the groove of the corrugated form portion.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchanger comprising:
- a plurality of heat transfer pipes for guiding a refrigerant; and
- a plurality of fins disposed spaced apart from each other to allow air to pass in a first direction,
- wherein each fin comprises:
  - a through-hole through which a respective one of the heat transfer pipes passes;
  - a corrugated form portion having an inclination with respect to the first direction;
  - a sheet portion including a surface parallel to the first direction around the through-hole; and
  - a connecting portion connecting the corrugated form portion and the sheet portion,
- wherein the sheet portion includes:
  - a first length in the first direction; and
  - a second length in a second direction perpendicular to the first direction, the second length being longer than the first length,
- wherein, for each fin, the connecting portion has an inclination with respect to a third direction orthogonal to the first direction and the second direction, and
- wherein the connection portion is formed to surround the sheet portion.

2. The heat exchanger of claim 1, wherein each fin further comprises a collar in surface contact with the respective heat transfer pipe, and
- wherein the sheet portion is connected to an outer surface of the collar.

3. The heat exchanger of claim 1, wherein each sheet portion is formed by a first arc passing through a first point at a first distal end of the first direction, a second arc passing through a second point at a second distal end point of the first direction, a third arc passing through a third point at a first distal end point of the second direction, and a fourth arc passing through a fourth point at a second distal end point of the second direction.

4. The heat exchanger of claim 3, wherein, for each fin, a center of curvature of the first arc and a center of curvature of the second arc are located symmetrically in the first direction with respect to a center of the respective heat transfer pipe.

5. The heat exchanger of claim 3, wherein, for each fin, a center of curvature of the third arc and a center of curvature of the fourth arc are located symmetrically in the second direction with respect to a center of the respective heat transfer pipe.

6. The heat exchanger of claim 3, wherein, for each fin, the first arc and the second arc have a first radius of curvature, and wherein the third arc and the fourth arc have a second radius of curvature greater than the first radius of curvature.

7. The heat exchanger of claim 1, wherein, for each fin, the sheet portion is formed in an elliptical shape in which two focal points are symmetrically located in the second direction with respect to a center of the respective heat transfer pipe.

8. The heat exchanger of claim 1, wherein each corrugated form portion is located between adjacent sheet portions.

9. The heat exchanger of claim 1, wherein a ratio of the second length of each sheet portion to the first length of the sheet portion is in a range of 1.2 to 1.9.

10. The heat exchanger of claim 1, wherein each corrugated form portion includes a plurality of inclined portions inclined with respect to the first direction.

11. The heat exchanger of claim 10, wherein each corrugated form portion includes:

four inclined portions;

two thread portions; and one groove portion.

12. The heat exchanger of claim 11, wherein, for each fin, a center of the through hole overlaps the groove portion in the second direction.

13. The heat exchanger of claim 11, wherein, for each fin, the two thread portions do not overlap with the through hole in the second direction.

14. The heat exchanger of claim 11, wherein, for each fin, the two thread portions are disposed not to overlap with the sheet portion in the second direction.

15. The heat exchanger of claim 11, wherein, for each fin, the two thread portions are located higher than the sheet portion in the third direction orthogonal to the first direction and the second direction.

16. An air conditioner comprising:

an indoor heat exchanger that exchanges heat with indoor air; and an outdoor heat exchanger that exchanges heat with outdoor air, wherein at least one of the indoor heat exchanger and the outdoor heat exchanger comprises:

a plurality of heat transfer pipes for guiding a refrigerant; and a plurality of fins disposed spaced apart from each other to allow air to pass in a first direction, wherein each fin comprises:

a through-hole through which a respective one of the heat transfer pipes passes;

a corrugated form portion having an inclination with respect to the first direction;

a sheet portion including a surface parallel to the first direction around the through-hole; and through hole, and a connecting portion connecting the corrugated form portion and the sheet portion, wherein the sheet portion includes:

a first length in the first direction; and a second length in a second direction perpendicular to the first direction, the second length being longer than the first length, wherein, for each fin, the connecting portion has an inclination with respect to a third direction orthogonal to the first direction and the second direction, and wherein the connection portion is formed to surround the sheet portion.

17. The air conditioner of claim 16, wherein each sheet portion is formed by a first arc passing through a first point at a first distal end of the first direction, a second arc passing through a second point at a second distal end point of the first direction, a third arc passing through a third point at a first distal end point of the second direction, and a fourth arc passing through a fourth point at a second distal end point of the second direction.

18. A fin comprising:

a corrugated form portion having an inclination with respect to a first direction; and a sheet portion including:

a through-hole configured to receive a heat transfer pipe therethrough;

a surface parallel to the first direction around the through-hole; and a connecting portion connecting the corrugated form portion and the sheet portion, wherein the sheet portion has a first length in the first direction, and has a second length longer than the first length in a second direction perpendicular to the first direction, wherein the connecting portion has an inclination with respect to a third direction orthogonal to the first direction and the second direction, and wherein the connection portion is formed to surround the sheet portion.

* * * * *